US012075935B1

(12) United States Patent
Giertz et al.

(10) Patent No.: US 12,075,935 B1
(45) Date of Patent: Sep. 3, 2024

(54) SYSTEMS FOR HANGING AND STORING ARTICLES OF CLOTHING IN CONFINED SPACES

(71) Applicant: This Is An Adventure, Inc., Los Angeles, CA (US)

(72) Inventors: Simone Giertz, Los Angeles, CA (US); Stuart McConnel, London (GB)

(73) Assignee: This Is An Adventure, Inc., Los Angeles, CA (US)

( * ) Notice: Subject to any disclaimer, the term of this patent is extended or adjusted under 35 U.S.C. 154(b) by 0 days.

(21) Appl. No.: 18/585,297

(22) Filed: Feb. 23, 2024

Related U.S. Application Data

(60) Provisional application No. 63/599,463, filed on Nov. 15, 2023.

(51) Int. Cl.
*A47G 25/40* (2006.01)
*A47G 25/36* (2006.01)

(52) U.S. Cl.
CPC ..... *A47G 25/40* (2013.01); *A47G 25/36* (2013.01)

(58) Field of Classification Search
CPC ..... A47G 25/40; A47G 25/4038; A47G 25/0692; A47G 25/1471
USPC ..... 223/89, 94
See application file for complete search history.

(56) References Cited

U.S. PATENT DOCUMENTS 1,644,503 A * 10/1927 Aumack ..... A47B 61/003 239/57
3,991,884 A * 11/1976 DeMaagd ..... A47F 3/08 211/1.51
5,480,076 A * 1/1996 Siegel ..... A47G 25/4038 403/111
5,718,358 A * 2/1998 Long ..... A47G 25/442 223/89
7,784,654 B1 * 8/2010 Mercado ..... A47G 25/4038 223/89
2021/0085112 A1 * 3/2021 Zadeh ..... A47G 25/4061

FOREIGN PATENT DOCUMENTS

WO WO-2016163664 A1 * 10/2016 ..... A47G 25/40

* cited by examiner

*Primary Examiner* — Nathan E Durham
(74) *Attorney, Agent, or Firm* — Akerman LLP

(57) ABSTRACT

Disclosed embodiments include a foldable hanger assembly and a clothing storage system that accommodates foldable hanger assemblies. Foldable hanger assembly embodiments comprise: (i) a first frame component with a hook; (ii) a second frame component; and (iii) a hinge assembly connecting the first frame component and the second frame component. In some examples, the hinge assembly comprises: (i) a first hinge insert attached to the first frame component; (ii) a second hinge insert attached to the second frame component; and (iii) a hinge clip that connects the first hinge insert to the second hinge insert, where the hinge clip allows the first frame component and the second frame component to pivot relative to each other from a horizontally open configuration into a horizontally closed configuration.

18 Claims, 14 Drawing Sheets

*Detail view with near shelf bracket hidden, showing rear panel for wall protection.*

SYSTEMS FOR HANGING AND STORING ARTICLES OF CLOTHING IN CONFINED SPACES

CROSS-REFERENCE TO RELATED APPLICATIONS

The present application claims priority to U.S. Provisional App. 63/599,463, titled "Systems for Hanging and Storing Articles of Clothing in Confined Spaces," filed on Nov. 15, 2023. The entire contents of U.S. Provisional App. 63/599,463 are incorporated by reference herein.

SUMMARY OF THE INVENTION

Most conventional clothing hangers are formed into (i) a triangular shaped frame to help the clothing keep its shape and (ii) a hook located above the frame for hanging clothing on a bar in a closet or on a clothing rack. One disadvantage of these conventional clothing hangers is that they require quite a bit of horizontal space in a closet. For example, conventional clothing hangers cannot be used in confined spaces, such as shallow closets or clothing racks with little back clearance, because the size and shape of conventional clothing hangers is fixed and cannot be changed. As a result, the bar, rack, track, or similar support on which conventional clothing hangers are hung must be placed sufficiently far from the wall to provide enough clearance to accommodate the physical dimensions of the clothing hanger while the clothing hanger is hung on the bar, rack, track, or other similar support.

To overcome this and other disadvantages of conventional clothes hangers, embodiments disclosed herein include a foldable clothing hanger assembly that takes up less horizontal space in a closet or other room, and can be used to store clothing in confined spaces, as compared to conventional clothing hangers.

Disclosed embodiments include a foldable hanger assembly comprising a hook, a frame assembly having a first frame component and a second frame component, and a hinge assembly that connects the first frame component and the second frame component. In some embodiments, the hinge assembly connects (and in some instances, detachably connects) the first frame component and the second frame component. In some embodiments, the first frame component comprises a wire (or other suitable material) formed into a first semi-triangular shape (or other suitable shape), wherein the hook is fixedly attached to a top of the first semi-triangular shape. In some embodiments, the second frame component comprises a wire (or other suitable material) formed into a second semi-triangular shape (or other suitable shape), wherein the first frame component is larger than the second frame component.

In some embodiments, the hinge assembly comprises a first hinge insert, a second hinge insert, and a hinge clip. The first hinge insert is fixedly attached to the first frame component and the second hinge insert component is fixedly attached to the second frame component. In operation, the hinge clip connects the first hinge insert to the second hinge insert. In some examples, the hinge clip is detachable and detachably connects the first hinge insert to the second hinge insert. The hinge assembly allows the first frame component and the second frame component to pivot relative to each other from a horizontally open configuration into a horizontally closed configuration.

The foldable hanger assembly can be used in several ways. For example, the foldable hanger assembly can be used in a closed configuration to store clothing more compactly than with a conventional hanger. Additionally, in embodiments where the first frame component and second frame component are detachable from each other, the first frame component can be detached from the second frame component and used by itself to store clothing more compactly than with a conventional hanger.

Some embodiments include a clothing storage system comprising a pair of brackets, a hanging rod, and at least one foldable hanger assembly. In some embodiments, the hanging rod has at least one groove for accommodating the hook of the foldable hanger assembly. In some embodiments, the hanging rod has a plurality of grooves, where each groove is configured to accommodate the hook of a corresponding foldable hanger assembly. In some embodiments, each bracket of the pair of brackets further comprises a mounting plate having two or more screw holes for fixing the mounting plate to a wall and a ring fixed to the mounting plate, wherein the ring surrounds an end of the hanging rod. In some alternative embodiments, the clothing storage system further comprises a shelf that is fixed to a wall. Each bracket of the pair of brackets further comprises a triangular shaped mounting plate (or other suitably-shaped mounting plate) with a hole, wherein the hole receives an end of the hanging rod, and the pair of brackets are fixed to the shelf.

The foldable hanger assembly embodiments disclosed herein provide several advantages. For example, disclosed embodiments provide a space-saving solution for storing clothing in confined spaces via an innovative design that enables the foldable hanger assembly to pivot from a horizontally open configuration to a horizontally closed configuration, thereby reducing the horizontal space required for hanging clothes by almost 50% as compared to conventional hangers. Additionally, the assembly features a hinge mechanism that not only facilitates the folding action but also maintains the foldable hanger assembly in any desired position between fully open and closed, thereby adding versatility and flexibility for storing various garment types. Further, in some embodiments, the detachable components of the foldable hanger assembly offer additional convenience, allowing for single component use or compact storage when not in use, further enhancing the utility and adaptability of the foldable hanger assembly for different storage environments.

DETAILED DESCRIPTION

Figure 1:
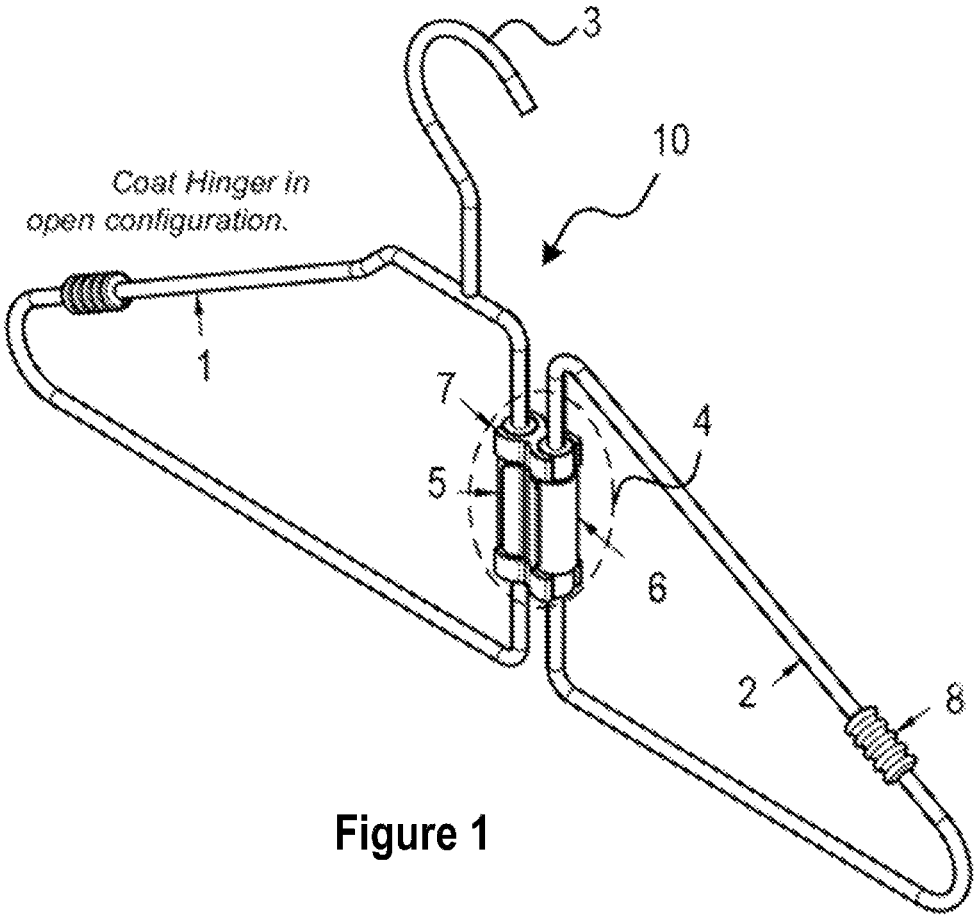
FIG. 1 shows a foldable hanger assembly according to some embodiments.
Figure 2:
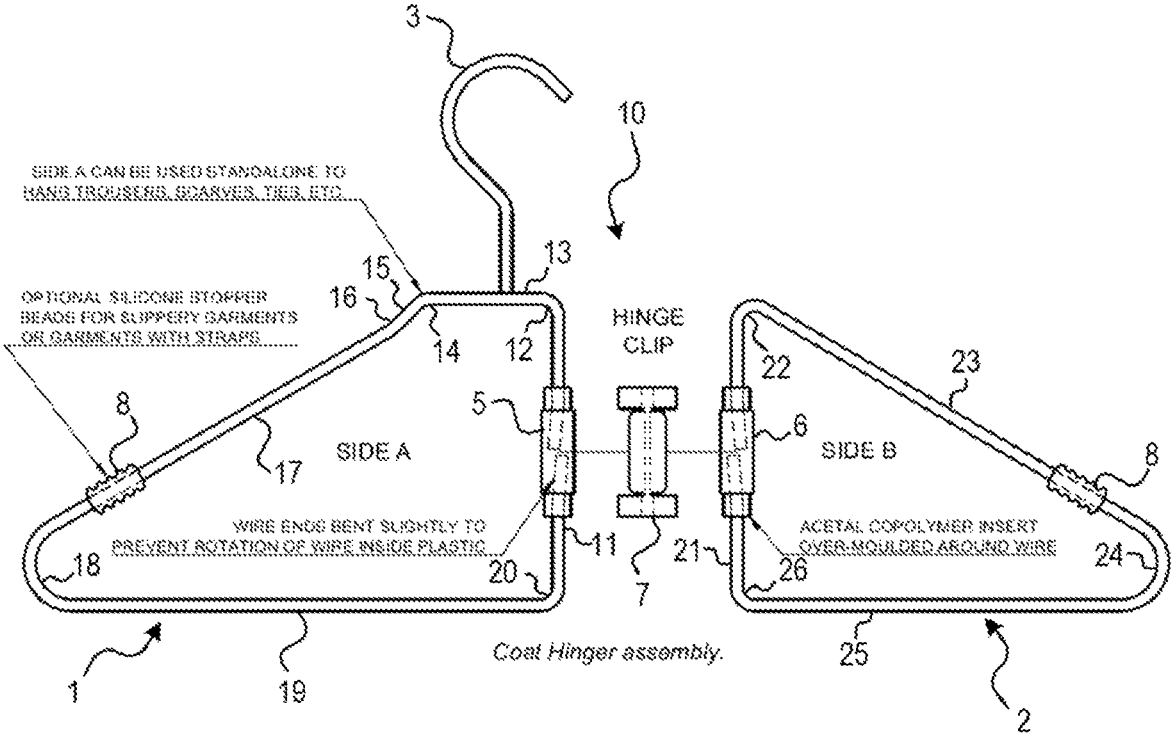
FIG. 2 shows an exploded view of a foldable hanger assembly according to some embodiments.

As shown in FIGS. 1 and 2, the foldable hanger assembly 10 includes a first frame component 1, a second frame component 2, and a hinge assembly 4. In some embodiments, the first frame component 1 and the second frame component 2 are formed out of wire or similarly suitable material. In the example embodiments shown in FIGS. 1 and 2, the wire (or similar material) is formed into triangular shapes, semi-triangular, or triangle-like shapes. However, the wire (or other suitable material) may be formed into any other shape that is suitable for hanging clothes.

The first frame component 1 and the second frame component 2 may be made out of metal wire, plastic, wood, or any other suitably rigid material. In some embodiments, the first frame component 1 and the second frame component 2 are formed from stainless steel wire.

The hinge assembly 4 for the foldable hanger assembly 10 includes a hinge clip 7, a first hinge insert 5, and a second hinge insert 6. The first hinge insert 5 is provided on the first frame component 1 and the second hinge insert 6 is provided on the second frame component 2.

Components of the hinge assembly 4 may be made from an injection molded plastic, such as acetal copolymer, or a combination of rubber and plastic. For example, the hinge inserts 5, 6 may be formed by an injection molding process, where the hinge inserts 5, 6 are molded onto the first frame component 1 and the second frame component 2, respectively. Similarly, the hinge clip 7 may also be formed by an injection molding process. In some embodiments, one or more components of the hinge assembly 4 may be formed from other materials, such as (i) metals, such as stainless steel, aluminum, brass, or other alloys, (ii) plastics, such as acetal copolymer, polypropylene, polycarbonate, ABS (Acrylonitrile Butadiene Styrene), or other thermoplastics, (iii) rubber, (iv) composites that combine fibers (e.g., carbon or glass) with a resin that offers desirable strength-to-weight ratios, or (v) any other material now known or later developed that would be suitable for the hinge assembly 4 components.

A hinge clip 7 holds the first hinge insert 5 and the second hinge insert 6 together to facilitate folding the of the foldable hanger assembly 10 as described herein.

In some embodiments, the hinge clip 7 includes (i) a first plurality of grooves on a first inner surface of the hinge clip 7 that are configured to engage with corresponding structures on the first hinge insert 5 and (ii) a second plurality of grooves on a second inner surface of the hinge clip 7 that are configured to engage with corresponding structures on the second hinge insert 6.

In some embodiments, the foldable hanger assembly 10 may additionally include optional stopper beads 8 to accommodate slippery garments or garments with straps. In some embodiments, the stopper beads 8 are positioned on the shoulder of each of the first frame component 1 and the second frame component 2. The stopper beads 8 may be made from any material with sufficient friction to secure the beads on the shoulders of the first frame component 1 and the second frame component 2. In some embodiments, the stopper beads 8 may be made of rubber, plastic, metal, or other suitable material. In operation, the stopper beads 8 prevent garments from sliding off the shoulders of first frame component 1 and second frame component 2.

In addition to the stopper beads 8, or perhaps as an alternative to the stopper beads 8, in some embodiments, the first frame component 1 and/or the second frame component 2 may additionally or alternatively include a notch, catch, or similar recess along the top portion to hold a garment strap.

In the example embodiments shown in FIGS. 1 and 2, the first frame component 1 is formed into a triangular or semi-triangular shape with a flat (or substantially flat) top segment by bending the wire from which the first frame component 1 is formed as described below. In the example shown in FIG. 2, the first frame component 1 contains five segments and five bends. The first bend 12 is formed between a right vertical segment 11 and top horizontal segment 13 of the first frame component 1, which forms a substantially right inner angle. The second bend 14 and third bend 16 create a short transitional segment 15 between the top horizontal segment 13 and the left shoulder segment 17 of the first frame component 1. The second bend 14 is formed between the top segment 13 and the transitional segment 15 of the first frame component 1, thereby forming a substantially obtuse inner angle. The third bend 16 is formed between the short transitional area 15 and the left shoulder segment 17 of the first frame component 1, thereby forming a substantially obtuse inner angle. The fourth bend 18 is formed between the left shoulder segment 17 and the bottom horizontal segment 19 of the first frame component 1, thereby forming a substantially acute inner angle. The fifth bend 20 is formed between the bottom horizontal segment 19 and the right vertical segment 11 of the first frame component 1, thereby forming a substantially right inner angle.

The first frame component 1 additionally includes a hook portion 3 having a vertical post. The vertical post is attached to the top horizontal segment 13 of the first frame component 1. In operation, the foldable hanger assembly 10 hangs from a clothes rod (e.g., rod 32 shown and described with reference to FIGS. 6-9 and 13-14) via hook portion 3.

In some embodiments, the ends of the wire of the first frame component 1 are hidden underneath the first hinge insert 5 where the first hinge insert 5 is molded onto the first frame component 1. In some example embodiments, the ends of the wire are bent slightly with respect to one another in order to prevent the rotation of the first frame component 1 inside of the first hinge insert 5, as indicated by the dotted lines showing the ends of the wire of the first frame component 1 within the first hinge insert 5.

As further shown in the example depicted in FIGS. 1 and 2, the second frame component 2 is formed into a triangular or semi-triangular shape by bending the wire of the second frame component 2 as described below. In the example shown in FIG. 2, the second frame component 2 contains three segments and three bends. The first bend 22 is formed between the vertical left segment 21 and the right shoulder segment 23 of the second frame component 2, thereby forming a substantially acute inner angle. The second bend 24 is formed between the right shoulder segment 23 and the bottom horizontal segment 25 of the second frame component 2, thereby forming a substantially acute inner angle. The third bend 26 is formed between the bottom horizontal segment 25 and the left vertical segment 21 of the second frame component 2, thereby forming a substantially right inner angle.

In some embodiments, the ends of the wire of the second frame component 2 are hidden underneath the second hinge insert 6 where the second hinge insert 6 is molded onto the second frame component 2. In some embodiments, the ends of the wire of the second frame component 2 are bent slightly with respect to one another in order to prevent the rotation of the second frame component 2 inside of the second hinge insert 6, as indicated by the dotted lines showing the ends of the wire of the second frame component 2 within the second hinge insert 6.

The configuration of the example first frame component 1 and second frame component 2 depicted in the figures is for illustration purposes only. Other suitable configurations of the first frame component 1 and second frame component 2 could be used as well.

Figure 3:
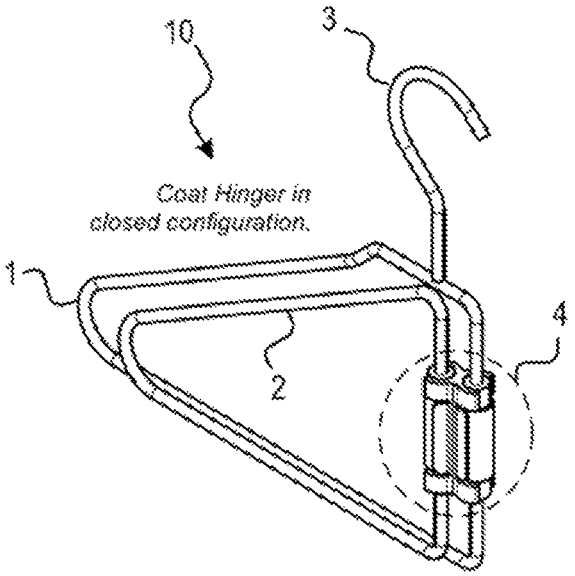
FIG. 3 shows a foldable hanger assembly in a closed configuration according to some embodiments.

FIG. 3 shows a foldable hanger assembly 10 in a closed configuration according to some embodiments. In the closed configuration, the second frame component 2 is folded back onto the first frame component 1 via the hinge assembly 4. While in this closed configuration, the foldable hanger assembly 10 takes up less horizontal space than when in the open configuration shown in FIG. 1.

Figure 4:
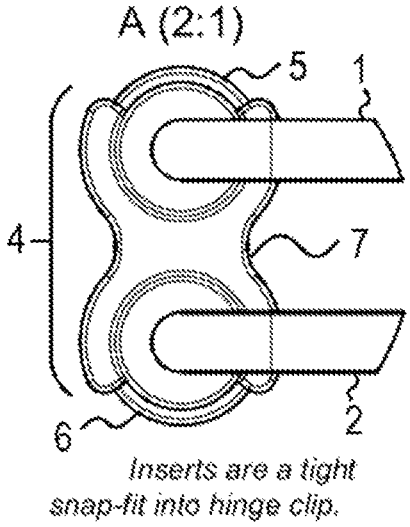
FIG. 4 shows a top view of a hinge assembly when the foldable hanger assembly is in a closed configuration according to some embodiments.

FIG. 4 shows a top view of a hinge assembly 4 when the foldable hanger assembly is in a closed configuration according to some embodiments.

The hinge assembly 4 allows the second frame component 2 to rotate approximately 180° around the first frame component 1 into the closed configuration. In some embodiments, the second frame component 2 is rotatable substantially 360° about the hinge assembly 4 relative to the first frame component 1. For example, when viewing the hanger assembly 10 from the top where the first frame component 1 and the second frame component 2 are both in the 12 o'clock position such that the hanger assembly 10 is in a closed configuration, (i) the second frame component 2 can be rotated clockwise or counterclockwise from the 12 o'clock position to the 6 o'clock position so that the hanger assembly 10 is in a fully horizontally open configuration, and (ii) the second frame component 2 can be rotated clockwise or counterclockwise from the 6 o'clock position back to the 12 o'clock position so that the hanger assembly 10 is in the horizontally closed configuration again.

The hinge assembly 4 further enables the first frame component 1 and the second frame component 2 to be moved to (and held in) substantially any position between the 6 o'clock and 12 o'clock positions.

In some embodiments, the hinge inserts 5, 6 are formed by an injection molding process, where the hinge inserts 5, 6 are over-molded onto the first frame component 1 and the second frame component 2, respectively, as described above. In some embodiments, the over-molded hinge inserts 5, 6 are configured to create a tight fit within each clip of the hinge clip 7. In operation, this tight fit creates friction between the hinge inserts 5, 6 and the hinge clip 7 such that the first frame component 1 and second frame component 2 may be rotated and secured into various positions between a horizontally open configuration and a horizontally closed configuration via the hinge assembly 4.

The hinge assembly 4 depicted in the figures is for illustration purposes only. Any other suitable hinge assembly configuration could alternatively be used that is arranged to (i) join (and optionally detachably join) frame component 1 with frame component 2, (ii) facilitate transitioning the foldable hanger assembly 10 between horizontally opened and closed configurations in either direction, and (iii) provide sufficient friction to hold the frame component 1 and frame component 2 in different positions between the horizontally open and closed configurations of the foldable hanger assembly 10.

For example, in some embodiments, the first hinge insert 5 and the second hinge insert 6 include integrated reinforcement ribs that provide the torsional rigidity to the hinge assembly 4, thereby preventing (or at least reducing the likelihood of) misalignment of the first frame component 1 and the second frame component 2, and ensuring (or at least increasing the likelihood of) consistent operation of the foldable hanger assembly 10 over time.

Figure 5A:
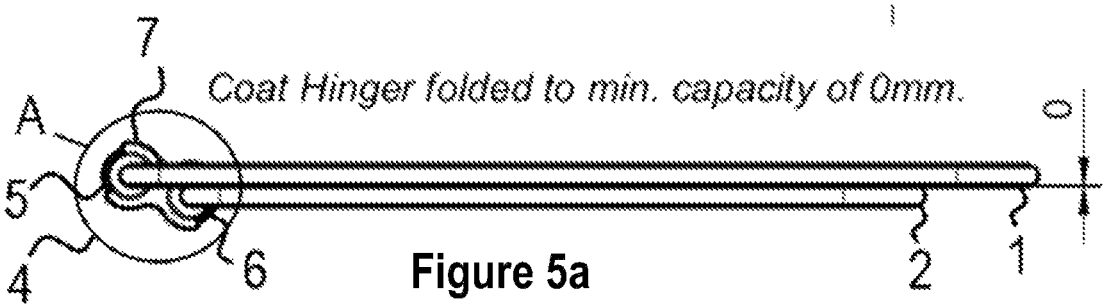
FIG. 5*a* shows a top view of a foldable hanger assembly in a closed configuration when the hinge inserts are staggered relative to one another according to some embodiments.
Figure 5B:
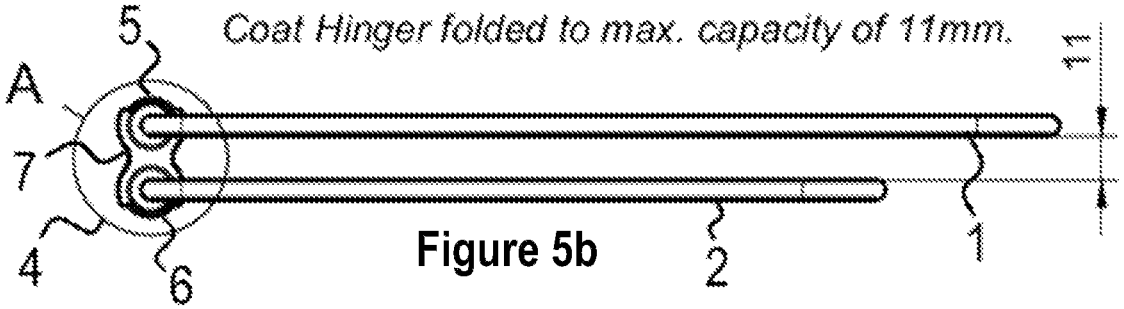
FIG. 5*b* shows a top view of a foldable hanger assembly in a closed configuration when the hinge inserts are parallel to one another according to some embodiments.

For example, in some embodiments, the hinge clip 7 of the foldable hanger assembly 10 is additionally equipped with a locking mechanism that provides an audible click when the first frame component 1 and the second frame component 2 are moved into the open position. In some embodiments, the locking mechanism additionally provides an audible click when the first frame component 1 and the second frame component 2 are moved into a closed position, including for example, one or both of the (i) the hinge inserts 5, 6 are staggered relative to one another as shown in FIG. 5*a* or (ii) the hinge inserts 5, 6 are parallel to one another as shown in FIG. 5*b*. In some embodiments, the locking mechanism is designed to provide tactile feedback to the user, confirming that the first frame component 1 and the second frame component 2 are securely fastened into a particular position. The audible click is generated by the engagement of a protrusion on one of the hinge inserts 5, 6 with a corresponding recess on the hinge clip 7, which together produce the sound and tactile sensation when properly aligned and engaged.

In further embodiments, the hinge clip 7 includes a textured surface to enhance the user's grip and facilitate the manipulation of the hinge assembly 4 when transitioning the foldable hanger assembly 10 between the horizontally open and closed configurations. The textured surface may comprise a series of raised ridges, dimples, or other tactile features that provide increased friction and prevent slippage during use, thereby improving the overall user experience when handling the foldable hanger assembly 10.

In some embodiments, the hinge clip 7 is configured with a quick-release button that, when pressed, enables detachment of the second hinge insert 6 (and the second frame component 2 to which the second hinge insert 6 is affixed) from the hinge clip 7. In some embodiments, the quick-release button is integrated into the hinge clip 7 and operates by disengaging a catch or latch mechanism within the hinge clip 7, thereby allowing the first frame component 1 and the second frame component 2 to be separated quickly and efficiently from each other without the need for additional tools or excessive force.

In some embodiments, the hinge clip 7 includes an holding mechanism that biases the hinge clip 7 towards a locked position when the foldable hanger mechanism 10 is in one or both of the horizontally open position and/or the horizontally closed position, thereby providing stability to the foldable hanger assembly 10 when in use. The holding mechanism may include any of a flexible plastic latch, a coiled spring, leaf spring, or other elastic component that exerts a force on the hinge clip 7 to ensure that it remains securely fastened to the hinge inserts 5, 6, thereby preventing accidental disassembly or movement of the frame components during storage of clothing.

FIG. 5*a* shows a top view of a foldable hanger assembly in a closed configuration when the hinge inserts are staggered relative to one another according to some embodiments. And FIG. 5*b* shows a top view of a foldable hanger assembly in a closed configuration when the hinge inserts are parallel to one another according to some embodiments. As shown in FIGS. 5*a* and 5*b*, the hinge assembly 4 allows the foldable hanger assembly 10 to fold into the closed configuration such that the first frame component 1 lies approximately parallel to the second frame component 2.

FIG. 5*a* shows how the hinge assembly 4 may be rotated such that the first hinge insert 5 of the first frame component 1 is staggered relative to the second hinge insert 6 of the second frame component 2 when viewing the foldable hanger assembly 10 in the closed configuration from above. In this orientation, there is no gap (or substantially no gap) between the first frame component 1 and the second frame component 2.

FIG. 5*b* shows how the hinge assembly 4 may be rotated such that the first hinge insert 5 of the first frame component 1 is substantially parallel to the second hinge insert 6 of the second frame component 2 when viewing the foldable hanger assembly 10 in the closed configuration from above. In this orientation, a gap may be formed between the first frame component 1 and the second frame component 2. In some instances, the gap formed between the first frame component 1 and the second frame component 2 is approximately 11 millimeters. In other embodiments and configurations, the gap may be more or less than approximately 11 millimeters.

In operation, the hinge assembly 4 also allows the first hinge insert 5 of the first frame component 1 and the second hinge insert 6 of the second frame component 2 to be rotated into various positions between the staggered and parallel configurations such that the gap between the first frame component 1 and the second frame component 2 may be anywhere between 0 millimeters and 11 millimeters in the example shown. In other examples having different dimensions, the first hinge insert 5 and the second hinge insert 6 may be rotated into various positions between the staggered and parallel configurations such that the gap between the first frame component 1 and the second frame component 2 is between 0 millimeters and a distance up to or exceeding 11 millimeters.

Figure 6:
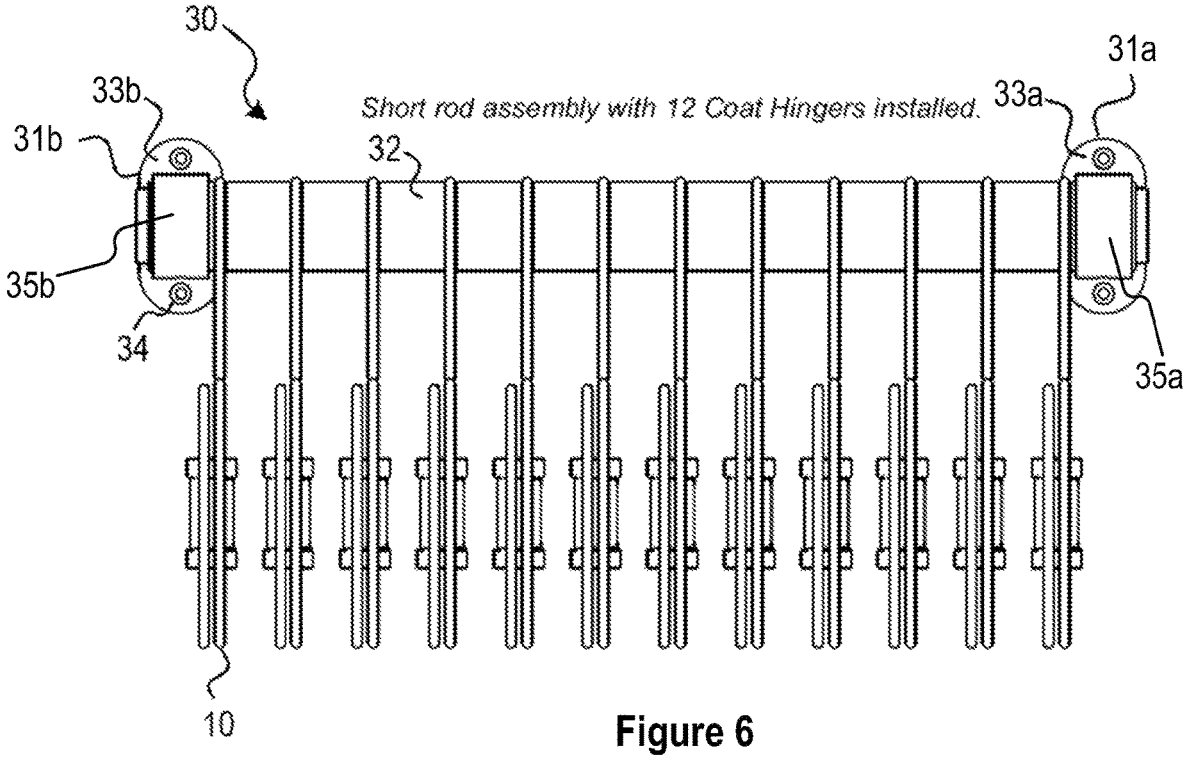
FIG. 6 shows a clothing storage system including a plurality of foldable hanger assemblies according to some embodiments.

FIG. 6 shows a clothing storage system 30 including a plurality of foldable hanger assemblies 10 according to some embodiments.

The system 30 includes two brackets 31*a* and 31*b*, a rod 32, and a least one foldable hanger assembly 10. The example depicted in FIG. 6 shows twelve foldable hanger assemblies, but other embodiments may accommodate more or fewer than twelve foldable hanger assemblies. In some embodiments, bracket 31*a* has mounting plate 33*a*, and bracket 31*b* has mounting plate 33*b*. Each bracket 31*a*, 31*b* has two screw holes (screw hole 34 shown) for fixing the brackets 31*a*, 31*b* to a wall.

Figure 8:
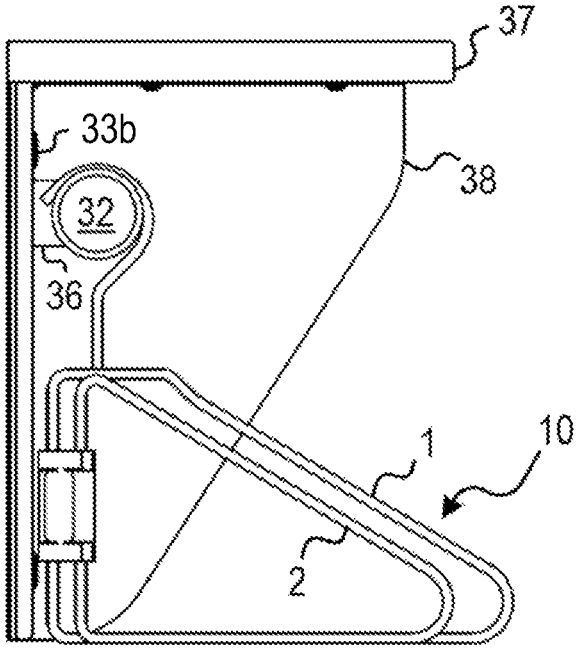
FIG. 8 shows a side view of the clothing storage system including the foldable hanger assembly according to some embodiments.

In addition, bracket 31*a* has a ring 35*a* and bracket 31*b* has a ring 35*b*. The rings 35*a*, 35*b* are attached to their respective mounting plates 33*a*, 33*b* by a stem 36 (FIG. 8). The length of the stem 36 may be such that the folding hanger assembly 10 sits flush or nearly flush against the wall when the folding hanger assembly 10 is placed on the hanging rod 32. The rings 35*a*, 35*b* may be sized such that the inner circumference of each ring is approximately equal to the outer circumference of an end of the hanging rod 32.

In another embodiment, the clothing storage system may include a shelf 37 (FIG. 8) that is fixed to the wall or perhaps the brackets 31*a*, 31*b* (or perhaps mounting plates 33*a*, 33*b* of the brackets 31*a*, 31*b*) by sets of screws, bolts, or other suitable attachment mechanisms. In some examples, the shelf 37 includes one or more supports 38 (FIG. 8) that may take a triangular or semi-triangular shaped form.

Figure 7:
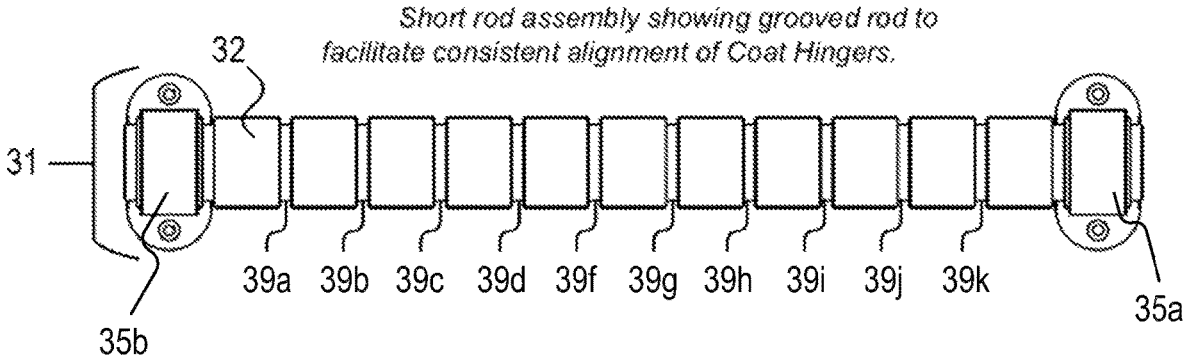
FIG. 7 shows a clothing storage system without a foldable hanger assembly according to some embodiments.

FIG. 7 shows a clothing storage system 31 without a foldable hanger assembly according to some embodiments.

As shown in FIG. 7, the hanging rod 32 may have several grooves 39*a-k*. Each groove 39*a-k* is configured to receive or otherwise accommodate a hook 3 (FIGS. 1-3) of a foldable hanger assembly 10. In some embodiments, the grooves 39*a-k* are equidistantly (or substantially equidistantly) spaced from one another along the hanging rod 32. In operation, the grooves 39*a-k* help to ensure that the foldable hanger assemblies hanging on the rod 32 hang vertically rather than twisting or leaning.

In some embodiments, each groove 39*a-k* is between about 3 mm to about 5 mm deep, and spaced between about 5 mm to about 6 mm from each other, thereby preventing foldable hanger assemblies hung from the rod 32 from sliding along the rod 32 or from twisting out of alignment. For example, a foldable hanger assembly 10 may be folded into the closed configuration before being placed on the hanging rod 32. When the hook of the foldable hanger assembly 10 is hung on the rod 32 in one of the grooves, the groove functions to hold the foldable hanger assembly 10 at an alignment where the two fame components (e.g., the first frame component 1 and the second frame component 2) extend substantially perpendicular from the rod 32, e.g., as shown in FIGS. 8, 9, 13, and 14. In other embodiments, the grooves may have other dimensions (depth and spacing) that are suitable to prevent the foldable hanger assemblies hung from the rod from sliding along the rod or from twisting out of alignment.

The folding hanger assembly 10 may also be disassembled, and the first frame component 1 may be placed on the hanging rod 32 without the second frame component 2. The hanging rod 32 may also be cut to a desired length by using a saw to cut the hanging rod 32 along any of the grooves 39.

FIG. 8 shows a side view of the clothing storage system including the foldable hanger assembly according to some embodiments.

In the side view shown in FIG. 8, the foldable hanger assembly 10 is shown hanging from the rod 32. The rod 32 is securely mounted to the wall by means of mounting plates 33*a* (not shown in the side view) and 33*b*, which are connected to the rod 32 via a stem 36. Positioned above the rod 32 is a shelf 37, which provides additional storage space and, in some instances, contributes to the overall structural integrity of the system. The shelf 37 is affixed to the mounting plates 33*a* (not shown in the side view) and 33*b* and the wall, thereby creating a cohesive unit with the mounting plates 33*a*, 33*b*, the stem 36, and the rod 32. Adding to the stability and aesthetic appeal of the system is a support 38, which exhibits a triangular or semi-triangular shape. This support 38 extends from the end of the shelf 37 and angles back towards the wall, interfacing with the wall below the location on the wall where the mounting plates 33*a* and 33*b* are attached. The support 38 reinforces and supports the shelf 37 and, at least in some embodiments, the design of the support 38 additionally provides a sleek and unobtrusive side-view profile for the clothing storage system.

One advantage of the foldable hanger assembly 10 is the ability to fold the second frame component 2 onto the first frame component 1 in manner shown in FIG. 8. The foldable hanger assembly 10 in the closed configuration is more compact and can be used in shallow closets or with clothing racks where there is limited space between the clothing rack and a back wall. For example, and as depicted in FIG. 8, the rod 32 on which the foldable hangable assembly 10 is hung can be positioned much closer to the wall than a rod for hanging a conventional hanger.

As shown in FIG. 8, the hinge assembly 4 sits nearly flush against the wall when the foldable hanger assembly 10 is hung in the closed configuration. The foldable hanger assembly 10 also allows for clothing to be hung on the foldable hanger assembly 10 while in the closed configuration. Another advantage of the foldable hanger assembly 10 is the ability to dissemble the hinge assembly 4 and use the first frame component 1 without the second frame component 2 attached thereto. In such a configuration, the first frame component 1 can be used by itself to hang articles of clothing, such as pants, scarves, or ties.

Figure 9:
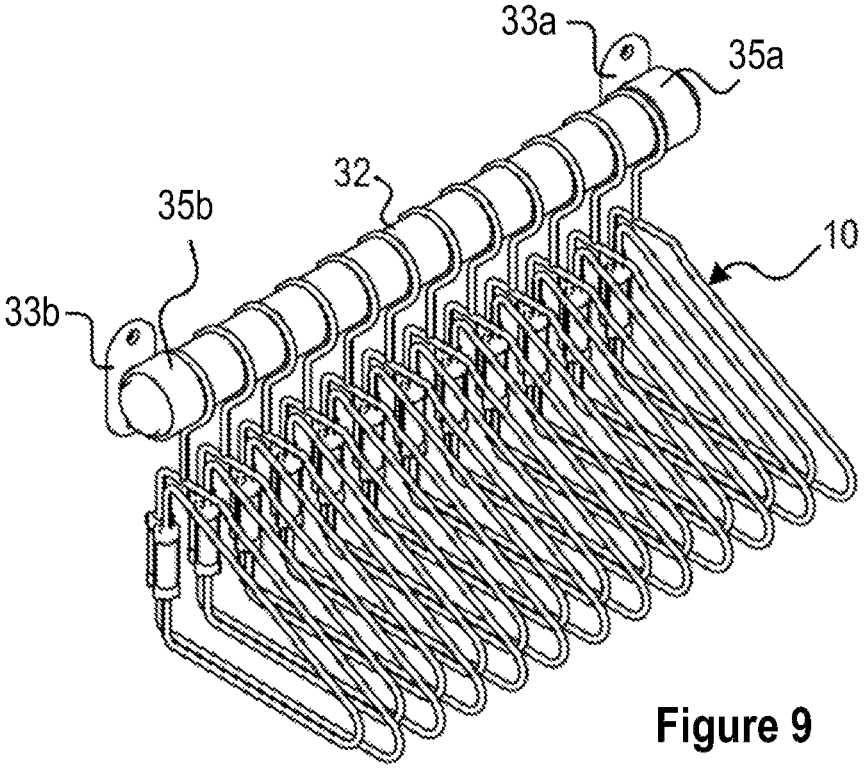
FIG. 9 shows a perspective view of the clothing storage system including a plurality of foldable hanger assemblies according to some embodiments.

FIG. 9 shows a perspective view of the clothing storage system including a plurality of foldable hanger assemblies according to some embodiments. In the example shown in FIG. 9, mounting plate 33*a* is mounted to a wall at the right end of the clothing storage system, and mounting plate 33*b* is mounted to the wall at the left end of the clothing storage system. Ring 35*a* is affixed to mounting plate 33*a*, and ring 35*b* is affixed to mounting plate 33*b*. In operation, rings 35*a*, 35*b* hold rod 32 in place, and the foldable hanger assembly 10 is hung from rod 32.

Figure 10:
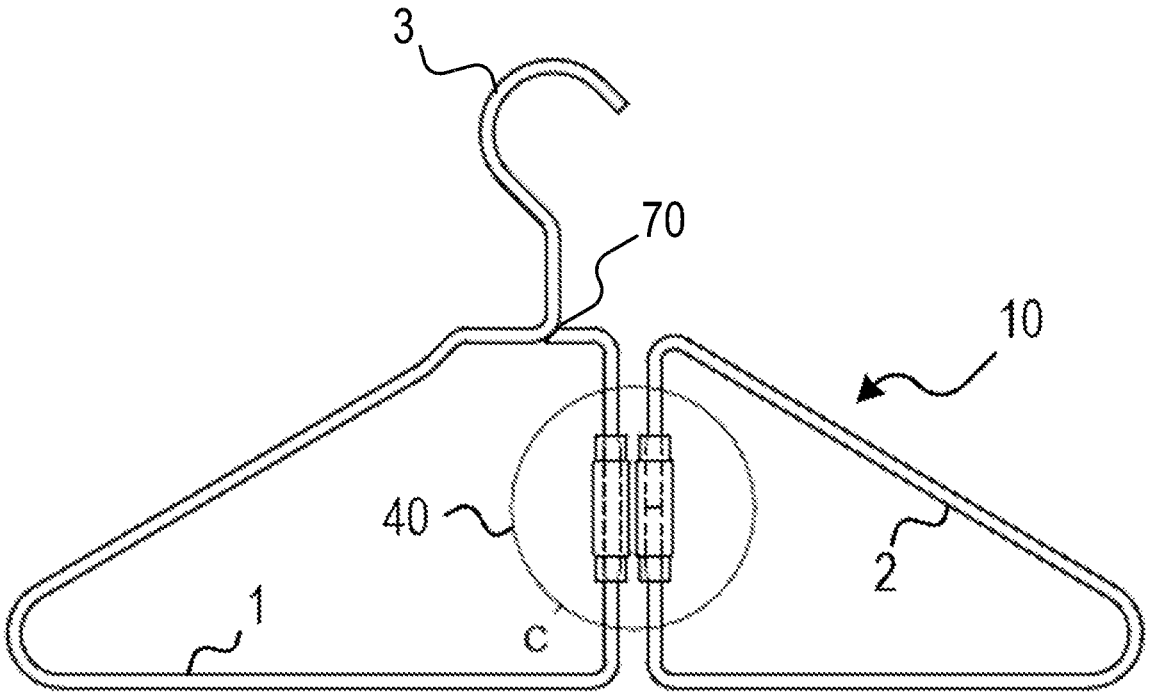
FIG. 10 shows a foldable hanger assembly with an alternative hinge assembly according to some embodiments.

FIG. 10 shows a foldable hanger assembly 10 with an alternative hinge assembly 40 according to some embodiments. The foldable hanger assembly 10 depicted in FIG. 10 is substantially the same as the foldable hanger assembly 10 depicted in FIGS. 1, 2, 3, 6, and elsewhere except that the foldable hanger assembly 10 in FIG. 10 includes an alternative hinge assembly 40.

In hinge assembly 4, and as illustrated in FIG. 2, wire ends of the first frame component 1 are positioned within hinge insert 5 such that the two ends are slightly twisted and offset from each other within the hinge insert 5. Wire ends of the second frame component 2 are similarly positioned within hinge insert 6 such that the two ends are slightly twisted and offset from each other within the hinge insert 6.

For example, in some embodiments, at least one of (i) the first hinge insert 5 is configured to enclose two ends of the first frame component 1, wherein the two ends of the first frame component enclosed within the first hinge insert 5 are slightly offset from each other, thereby inhibiting rotational movement of the two ends of the first frame component 1 within the first hinge insert 5, and (ii) the second hinge insert 6 is configured to enclose two ends of the second frame component 2, where the two ends of the second frame component enclosed within the second hinge insert 6 are also slightly offset from each other, thereby inhibiting rotational movement of the two ends of the second frame component 2 within the second hinge insert 6.

Details of the alternative hinge assembly 40 are shown and described with reference to FIGS. 11 and 12.

Figure 11:
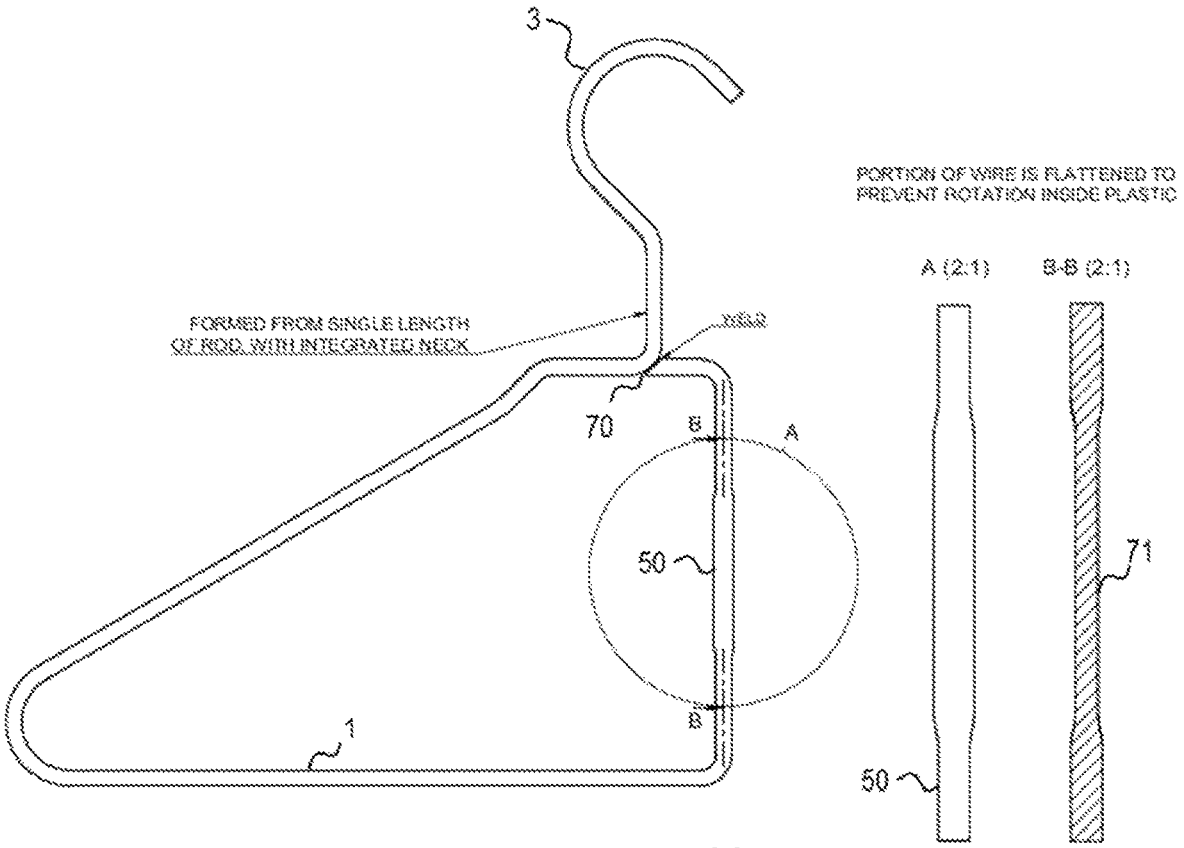
FIG. 11 shows a foldable hanger assembly with a alternative hinge insert according to some embodiments.

FIG. 11 shows a first frame component 1 of a foldable hanger assembly 10 with a alternative hinge insert 50 of the alternative hinge assembly 40 according to some embodiments. In contrast to the hinge insert 5 shown in FIG. 2, the wire of the first frame component 1 runs through the length of the alternative hinge insert 50. To help secure the wire of the first frame component 1 within the alternative hinge insert 50 and prevent the alternative hinge insert 50 from spinning about the wire of the first frame component 1, a portion 71 of the wire of the first frame component 1 within the alternative hinge insert 50 is at least partially flattened. In some embodiments, the portion 71 of the wire of the first frame component 1 within the alternative hinge insert 50 may alternatively be twisted or have some other structural attribute or deformation that prevents the hinge insert 50 from rotating about the wire of the first frame component 1, or at least reduces the likelihood that the hinge insert 50 will rotate about the wire of the first frame component 1.

Further, rather than having the two ends of the wire of the first frame component terminating within the hinge insert 5 as shown in the hinge assembly 4 illustrated in FIG. 2, the wire of the first frame component 1 in the alternative hinge assembly runs through the alternative hinge assembly and is welded at point 70 near the base of hook 3.

For example, in some embodiments, at least one of: (i) a portion of the first frame component 1 extends through and is enclosed within the first hinge insert 50, where at least some of the portion of the first frame component 1 enclosed within the first hinge insert 50 is at least partially deformed, thereby inhibiting rotational movement of the portion of the first frame component 1 within the first hinge insert 50; and (ii) a portion of the second frame component 2 extends through and is enclosed within the second hinge insert 60, where at least some of the portion of the second frame component 2 enclosed within the second hinge insert 60 is at least partially deformed, thereby inhibiting rotational movement of the portion of the second frame component 1 within the second hinge insert 60.

In some embodiments, one or more features of the hinge assembly 4 (FIG. 2) may be combined with one or more features of alternative hinge assembly 40 (FIG. 11).

Figure 12:
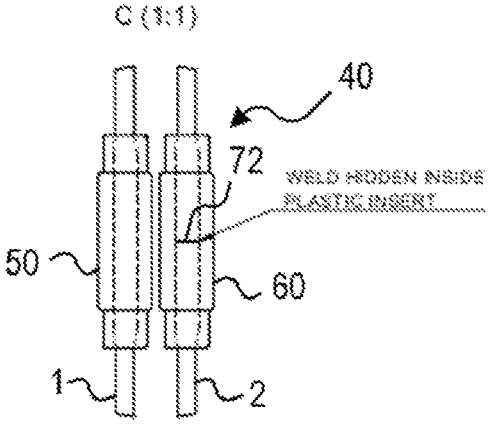
FIG. 12 shows further aspects of the alternative hinge assembly with an alternative hinge insert according to some embodiments.

FIG. 12 shows further aspects of the alternative hinge assembly 40, including alternative hinge inserts 50 and 60 on the first frame component 1 and the second frame component 2, respectively. The alternative hinge assembly 40 can be used with the same hinge clip 7 shown and described with reference to FIGS. 1, 2, 3, 4, and 5*a*-*b*. However, alternative hinge assembly 40 uses alternative hinge inserts 40, 50 as compared to the hinge inserts 4, 5 of hinge assembly 4.

As described previously with reference to FIG. 11, the wire of the first frame component 1 runs through the length of the alternative hinge insert 50. In the example shown in FIG. 12, the two ends of the wire of the second frame component 2 meet within the alternative hinge insert 60 at weld point 72. In some embodiments, a portion of one or both ends of the wire of the second frame component 2 within the alternative hinge insert 60 are flattened, twisted, or otherwise deformed to help prevent the alternative hinge insert 60 from spinning about the wire of the second frame component 2.

In some embodiments, the first frame component 1 includes the alternative clip 50 shown in FIGS. 10-12, and the second frame component 2 includes the hinge clip 6 shown in FIG. 2. Similarly, in some embodiments, the first frame component 1 includes the hinge clip 5 shown in FIG. 2, and the second frame component 2 includes the alternative hinge clip 60 shown in FIGS. 10-12.

From a user standpoint, the alternative hinge assembly 40 operates in the same (or substantially the same) manner as hinge assembly 4. Further, hinge assembly 4 and alternative hinge assembly 40 look substantially identical to an end user.

Figure 13:
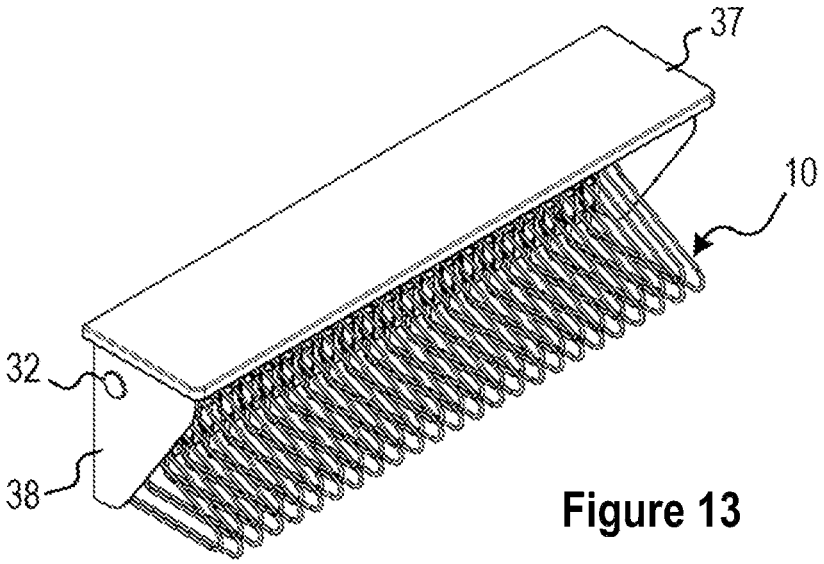
FIG. 13 shows a perspective view of an example clothing storage system according to some embodiments.

FIG. 13 shows a perspective view of an example clothing storage system with a shelf 37 and configured to accommodate twenty-four hanger assemblies 10 from rod 32 according to some embodiments. FIG. 13 also shows support 38 on the side with a portion of rod 32 extending therethrough.

Figure 14:
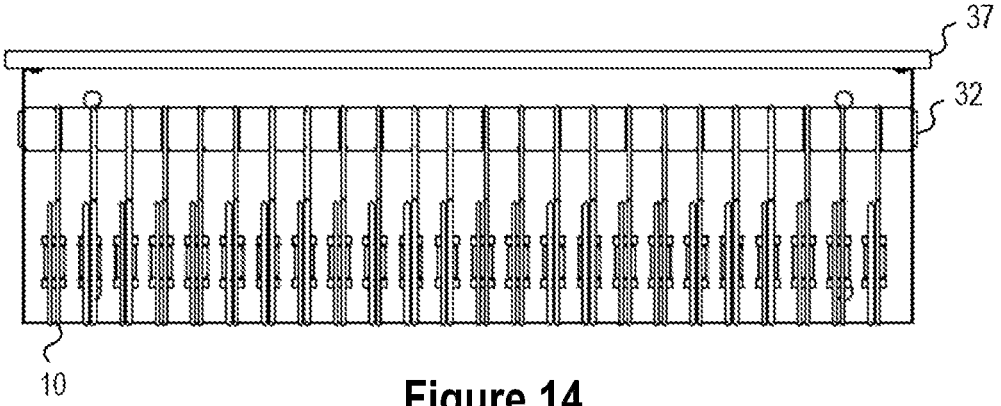
FIG. 14 shows a front-facing view of an example clothing storage system according to some embodiments.

FIG. 14 shows a front-facing view of an example clothing storage system with a shelf 37 and configured to accommodate twenty-four hanger assemblies 10 from rod 32 according to some embodiments.

The embodiments disclosed herein are presented for purposes of illustration and not limitation. It should be understood that various features and aspects of the disclosed embodiments can be combined with one another in a manner consistent with the principles and teachings herein, provided that the features are not mutually exclusive. Further, the different components (and subcomponents thereof) are described in various embodiments as formed from metal wire, plastic, wood, composites, or other materials for purposes of illustration and not limitation. Persons of skill in the art will understand that the different components (and portions thereof) can be formed from any material or combination of materials that is suitable for achieving the purpose of the component (or subcomponent thereof), including but not limited to any suitable metal, plastic, wood, composite, or other material (or any combination thereof). Those of ordinary skill in the art will appreciate the interchangeability of features and the flexibility in selecting and combining aspects of the different embodiments to achieve the desired goals and realize the benefits of the disclosed systems and methods. It is intended that such combinations and modifications fall within the scope of the appended claims and their equivalents.

What is claimed is:

1. A foldable hanger assembly comprising:

a first frame component comprising a hook extending from a top of the first frame component;

a second frame component;

a hinge assembly that connects the first frame component and the second frame component, wherein the hinge assembly comprises:

a first hinge insert attached to the first frame component, wherein one of (i) the first hinge insert is configured to enclose two ends of the first frame component, and wherein the two ends of the first frame component enclosed within the first hinge insert are slightly offset from each other, thereby inhibiting rotational movement of the two ends of the first frame component within the first hinge insert or (ii) a portion of the first frame component extends through and is enclosed within the first hinge insert, wherein at least some of the portion of the first frame component enclosed within the first hinge insert is at least partially deformed, thereby inhibiting rotational movement of the portion of the first frame component within the first hinge insert;

a second hinge insert attached to the second frame component, wherein one of (i) the second hinge insert is configured to enclose two ends of the second frame component, and wherein the two ends of the second frame component enclosed within the second hinge insert are slightly offset from each other, thereby inhibiting rotational movement of the two ends of the second frame component within the second hinge insert or (ii) a portion of the second frame component extends through and is enclosed within the second hinge insert, wherein at least some of the portion of the second frame component enclosed within the second hinge insert is at least partially deformed, thereby inhibiting rotational movement of the portion of the second frame component within the second hinge insert; and a hinge clip that connects the first hinge insert with the second hinge insert, wherein the hinge clip is configured to allow the first frame component and the second frame component to pivot relative to each other from a horizontally open configuration into a horizontally closed configuration, and wherein the hinge clip is configured to hold the first frame component and the second frame component in any position between the horizontally open configuration and the horizontally closed configuration.

2. The foldable hanger assembly of claim 1, wherein in the horizontally closed configuration, the second frame component aligns approximately parallel to the first frame component.

3. The foldable hanger assembly of claim 1, wherein the first frame component comprises a wire formed into a first semi-triangular shape, and wherein the second frame component comprises a wire formed into a second semi-triangular shape.

4. The foldable hanger assembly of claim 1, wherein the hinge clip is formed from an injection molded plastic material.

5. The foldable hanger assembly of claim 1, wherein the hinge clip includes (i) a first plurality of grooves configured to engage with corresponding structures on the first hinge insert and (ii) a second plurality of grooves configured to engage with corresponding structures on the second hinge insert.

6. The foldable hanger assembly of claim 1, wherein the hinge clip further comprises a locking mechanism that provides an audible click when the first frame component and the second frame component are moved into different positions.

7. The foldable hanger assembly of claim 1, wherein the hinge clip is further configured to enable the second frame component to be detached from the hinge clip, thereby facilitating separation of the second frame component from the first frame component.

8. The foldable hanger assembly of claim 7, wherein the first frame component is configured to hang an article of clothing after the second frame component has been detached from the first frame component.

9. The foldable hanger assembly of claim 1, further comprising one or more structures positioned along a top portion of each of the first frame component and the second frame component, wherein the one or more structures are configured to prevent garments from sliding off of the first frame component and the second frame component.

10. The foldable hanger assembly of claim 1, wherein the hinge clip is configured to allow the first frame component and the second frame component to be held in a staggered configuration when the foldable hanger assembly is in the horizontally closed configuration.

11. The foldable hanger assembly of claim 1, wherein the hinge clip is configured to allow the first frame component and the second frame component to be held in a parallel configuration to create a gap between the first frame component and the second frame component when in the horizontally closed configuration.

12. The foldable hanger assembly of claim 1, wherein the hinge clip is configured to allow the first frame component and the second frame component to be rotated and secured into various positions between the horizontally open configuration and the horizontally closed configuration via the hinge assembly.

13. The foldable hanger assembly of claim 1, wherein the first hinge insert and the second hinge insert include integrated reinforcement ribs that provide torsional rigidity to the hinge assembly.

14. The foldable hanger assembly of claim 1, wherein the hinge clip includes a textured surface to enhance grip and facilitate manipulation of the hinge assembly when transitioning between the horizontally open configuration and the horizontally closed configuration.

15. A clothing storage system comprising:

a pair of mounting brackets, wherein each mounting bracket comprises a mounting plate configured to attach the mounting bracket to a wall;

a rod supported by the mounting brackets and configured to receive at least one foldable hanger assembly; and at least one foldable hanger assembly configured to hang from the rod, wherein the at least one foldable hanger assembly comprises:

a first frame component comprising a hook extending from a top of the first frame component;

a second frame component; and a hinge assembly that connects the first frame component and the second frame component, wherein the hinge assembly comprises:

a first hinge insert attached to the first frame component, wherein one of (i) the first hinge insert is configured to enclose two ends of the first frame component, and wherein the two ends of the first frame component enclosed within the first hinge insert are slightly offset from each other, thereby inhibiting rotational movement of the two ends of the first frame component within the first hinge insert or (ii) a portion of the first frame component extends through and is enclosed within the first hinge insert, wherein at least some of the portion of the first frame component enclosed within the first hinge insert is at least partially deformed, thereby inhibiting rotational movement of the portion of the first frame component within the first hinge insert;

a second hinge insert attached to the second frame component, wherein one of (i) the second hinge insert is configured to enclose two ends of the second frame component, and wherein the two ends of the second frame component enclosed within the second hinge insert are slightly offset from each other, thereby inhibiting rotational movement of the two ends of the second frame component within the second hinge insert or (ii) a portion of the second frame component extends through and is enclosed within the second hinge insert, wherein at least some of the portion of the second frame component enclosed within the second hinge insert is at least partially deformed, thereby inhibiting rotational movement of the portion of the second frame component within the second hinge insert; and a hinge clip that connects the first hinge insert to the second hinge insert, wherein the hinge clip is configured to allow the first frame component and the second frame component to pivot relative to each other from a horizontally open configuration into a horizontally closed configuration, and wherein the hinge clip is configured to hold the first frame component and the second frame component in any position between the horizontally open configuration and the horizontally closed configuration.

16. The clothing storage system of claim 15, further comprising:

a shelf positioned above the rod, wherein the shelf is connected to the mounting brackets; and a support extending from the shelf to the wall.

17. The clothing storage system of claim 15, wherein the rod includes a plurality of grooves, wherein each groove is configured to accommodate a hook of a corresponding foldable hanger assembly, thereby organizing foldable hanger assemblies hung from the rod and preventing foldable hanger assemblies hung from the rod from sliding along the rod or twisting out of an alignment that is substantially perpendicular to the rod.

18. The clothing storage system of claim 15, wherein each mounting bracket further comprises a stem extending from the mounting bracket, wherein the stem is configured to position the rod at a length from the wall such that the at least one foldable hanger assembly sits flush or nearly flush against the wall when the at least one foldable hanger assembly is placed on the rod.

* * * * *